US011179839B2

(12) United States Patent
Yen et al.

(10) Patent No.: US 11,179,839 B2
(45) Date of Patent: Nov. 23, 2021

(54) HANDHELD MACHINE TOOL

(71) Applicant: Fairway Electronic Co., Ltd., New Taipei (TW)

(72) Inventors: Lin-Han Yen, New Taipei (TW); Yu-Jen Fang, New Taipei (TW)

(73) Assignee: FAIRWAY ELECTRONIC CO., LTD., New Taipei (TW)

( * ) Notice: Subject to any disclaimer, the term of this patent is extended or adjusted under 35 U.S.C. 154(b) by 401 days.

(21) Appl. No.: 16/299,854

(22) Filed: Mar. 12, 2019

(65) Prior Publication Data

US 2020/0230796 A1 Jul. 23, 2020

(30) Foreign Application Priority Data

Jan. 23, 2019 (TW) ..... 108201078

(51) Int. Cl.

| | |
|---|---|
| ***B24B 23/02*** | (2006.01) |
| ***B25F 5/00*** | (2006.01) |
| ***B25F 5/02*** | (2006.01) |
| ***B24B 23/00*** | (2006.01) |
| *B25F 3/00* | (2006.01) |
| *A46B 13/02* | (2006.01) |

(52) U.S. Cl.

CPC ..... *B25F 5/001* (2013.01); *B24B 23/00* (2013.01); *B25F 5/02* (2013.01); *A46B 13/02* (2013.01); *B24B 23/005* (2013.01); *B24B 23/02* (2013.01); *B25F 3/00* (2013.01)

(58) Field of Classification Search

CPC ..... B24B 23/00; B24B 23/03; B24B 23/04; B24B 47/12; B24B 55/00; B24D 9/08; B25F 5/00; B25F 5/02; A46B 13/02; A46B 13/008

USPC ..... 173/29, 2, 217, 216, 170; 15/21.1, 22.1, 15/24, 29, 143.1, 144.4; 451/270, 344, 451/357, 510, 358, 359; 310/50

See application file for complete search history.

(56) References Cited

U.S. PATENT DOCUMENTS

| | | | | |
|---|---|---|---|---|
| 2,678,457 A * | 5/1954 | Demo | A46B 13/06 | 15/29 |
| 3,396,417 A * | 8/1968 | Starr | A47L 1/05 | 15/29 |
| 3,510,992 A * | 5/1970 | Hutchins | B24D 9/08 | 451/510 |

(Continued)

*Primary Examiner* — Scott A Smith

(74) *Attorney, Agent, or Firm* — Muncy, Geissler, Olds & Lowe, P C.

(57) ABSTRACT

A handheld machine tool comprises a machine tool main body and a tool part. The machine tool main body comprises a round housing, a grip portion and a convex portion. The round housing is a cylindrical shape and has a shaft accommodation portion disposed at the bottom. The tool part is connected to the machine tool main body through the shaft accommodation portion. The grip portion and the convex portion are disposed on a side of the round housing. The handheld machine tool further comprises a first button and a second button. The first button is located in an inertial direction of rotation of the machine tool main body during operation. When a user keeps pressing the first button with the finger to drive the tool part to operate continuously, the machine tool main body pushes the first button to the finger pressed thereon along the inertia direction.

6 Claims, 4 Drawing Sheets

(56) References Cited

U.S. PATENT DOCUMENTS 3,638,264 A * 2/1972 Walton ..... A46B 13/04 15/4
4,168,560 A * 9/1979 Doyel ..... A46B 13/04 15/29
4,321,722 A * 3/1982 Klocke ..... A46B 13/06 15/29
4,796,321 A * 1/1989 Lee ..... A46B 13/04 15/29
5,289,605 A * 3/1994 Armbruster ..... A47L 11/282 15/144.4
5,392,568 A * 2/1995 Howard, Jr. ..... B24B 23/03 451/344
5,423,102 A * 6/1995 Madison ..... A46B 13/04 15/22.1
5,595,531 A * 1/1997 Niemela ..... B24B 23/03 451/357
5,701,625 A * 12/1997 Siman ..... A46B 13/02 15/21.1
5,709,596 A * 1/1998 Alexander ..... B24B 23/04 15/143.1
5,718,014 A * 2/1998 deBlois ..... A46B 13/008 15/22.1
5,775,539 A * 7/1998 Bates ..... B05C 17/0103 222/1
5,960,503 A * 10/1999 Del Pozo Y Mattei ..... A46B 11/066 15/24
6,984,901 B2 * 1/2006 Wong ..... A46B 13/008 15/320
7,198,559 B2 * 4/2007 Waistrum ..... B24B 23/03 451/270
7,222,679 B1 * 5/2007 Dohogne ..... B24B 23/005 15/97.1
7,363,673 B2 * 4/2008 Schonewille ..... A47L 13/26 15/29
7,414,337 B2 * 8/2008 Wilkinson ..... B25F 5/00 15/21.1
7,476,144 B2 * 1/2009 Dineen ..... B24B 23/00 451/354
7,771,253 B2 * 8/2010 Wuensch ..... B24B 23/04 451/344
8,678,884 B2 * 3/2014 Tanimoto ..... B24B 47/12 451/359
9,314,095 B2 * 4/2016 Hwang ..... A46B 13/008
9,408,513 B2 * 8/2016 Elen ..... A47L 11/12
2003/0143935 A1 * 7/2003 Huber ..... B24B 55/105 451/357
2017/0089118 A1 * 3/2017 Li ..... H02K 1/146

* cited by examiner

HANDHELD MACHINE TOOL

RELATED APPLICATIONS

The present application claims the priority of Taiwan Application No. 108201078, filed Jan. 23, 2019, the disclosure of which is hereby incorporated by reference herein in its entirety.

BACKGROUND OF THE INVENTION

1. Field of the Invention

The present disclosure generally relates to a handheld machine tool, and, more particularly, to a handheld machine tool with small size and hand grasping design.

2. Description of the Related Art

Handheld machine tools, such as polishing machines or waxing machines, are available in a wide variety of applications. In simple terms, it can be distinguished according to the power source, such as pneumatic or plug-in, or the running track of the machine, such as eccentric or self-rotating. Users choose according to their needs. However, most of the handheld machine tools currently on the market are bulky and heavy. It is inconvenient for some users to operate those handheld machine tools. They can't use those tools handily.

Therefore, how to simplify the internal mechanism and design a handheld machine tool convenient for the hand to grasp and operate is a problem still to be solved in the industry.

SUMMARY OF THE INVENTION

In light of solving the foregoing problems of the prior art, the present invention provides a handheld machine tool. The handheld machine tool according to the present invention comprises a machine tool main body and a tool part. The machine tool main body comprises: a round housing which is a cylindrical shape wide at the top and narrow at the bottom, the round housing having a shaft accommodation portion disposed at the bottom, and the shaft accommodation portion having an opening; a grip portion disposed on a side of the round housing; and a convex portion disposed on a side of the round housing. The tool part connecting to the machine tool main body through the shaft accommodation portion. The handheld machine tool further comprises a first button disposed on a side of the round housing. The first button is located in an inertial direction of rotation of the machine tool main body during operation. When a user keeps pressing the first button with the finger to cause the machine tool main body to drive the tool part to operate continuously, the machine tool main body pushes the first button to the finger pressed thereon along the inertia direction.

In an embodiment, an outer casing of the machine tool main body is composed of two hollow shells combined up and down, and the two hollow shells form an accommodating space inside the two hollow shells when they are combined.

In an embodiment, the machine tool main body further comprises a transmission module disposed inside the round housing, and the first button is used to activate the transmission module.

In an embodiment, the transmission module comprises a transmission shaft and a motor, the transmission shaft is disposed at the opening of the shaft accommodation portion to connect the tool part, and the motor is disposed inside the convex portion.

In an embodiment, the handheld machine tool further comprises a second button disposed at a side of the round housing and adjacent to the convex portion, wherein the second button is used to set the motor speed of the transmission module.

In an embodiment, the machine tool main body further comprises a power module disposed inside the grip portion, wherein the power module is used to provide the power for the transmission module.

Compared with the handheld machine tool which is relatively large and heavy in the prior art and requires to be hold with two hands, the handheld machine tool provided by the present invention effectively simplifies internal mechanisms, and thereby to reduce the overall size of the handheld machine tool and allow the user to hold it in a single hand during operation. In addition, the design of buttons according to the present invention also allows the user to save more effort when operating the handheld machine tool. It is a very practical improvement.

BRIEF DESCRIPTION OF THE DRAFLAPS

FIG. 1-2 is a second perspective schematic view of the machine tool main body of the handheld machine tool according to the present invention;

FIG. 2 is a schematic exploded view of the handheld machine tool according to the present invention.

DETAILED DESCRIPTION

Figure 1:
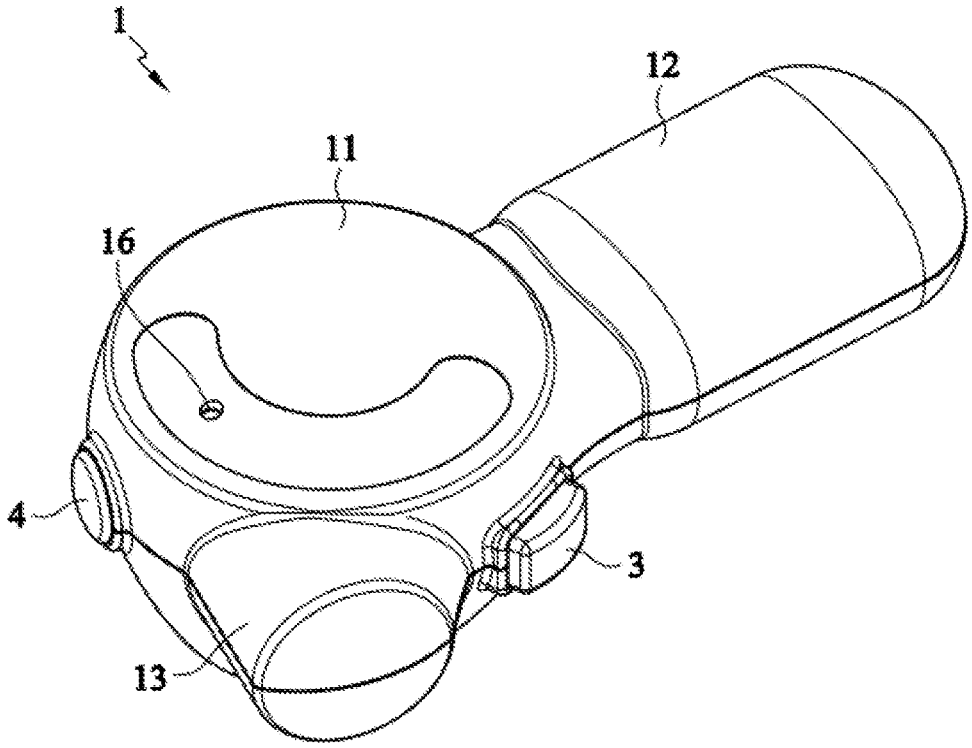
FIG. 1-1 is a first perspective schematic view of the machine tool main body of the handheld machine tool according to the present invention.

The present invention is described by the following specific embodiments. Those with ordinary skills in the arts can readily understand other advantages and functions of the present invention after reading the disclosure of this specification. Any changes or adjustments made to their relative relationships, without modifying the substantial technical contents, are also to be construed as within the range implementable by the present invention.

It should be noted that the structures, ratios, sizes shown in the drawings appended to this specification are to be construed in conjunction with the disclosure of this specification in order to facilitate understanding of those skilled in the art. They are not meant, in any ways, to limit the implementations of the present invention, and therefore have no substantial technical meaning. Without affecting the effects created and objectives achieved by the present invention, any modifications, changes or adjustments to the structures, ratio relationships or sizes, are to be construed as fall within the range covered by the technical contents disclosed herein. Meanwhile, terms, such as "top", "bottom", "inner", "one", "a" and the like, are for illustrative purposes only, and are not meant to limit the range implementable by the present invention. Any changes or adjustments made to their relative relationships, without modifying the substantial technical contents, are also to be construed as within the range implementable by the present invention.

Figures 1, 2:
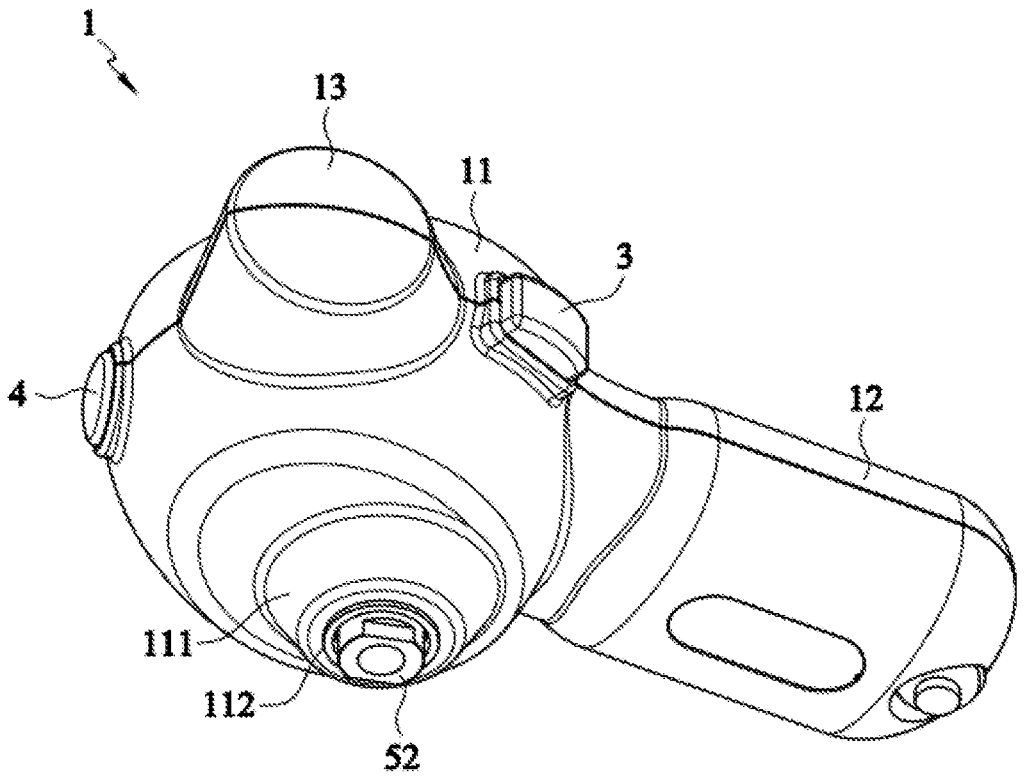
Figure 2:
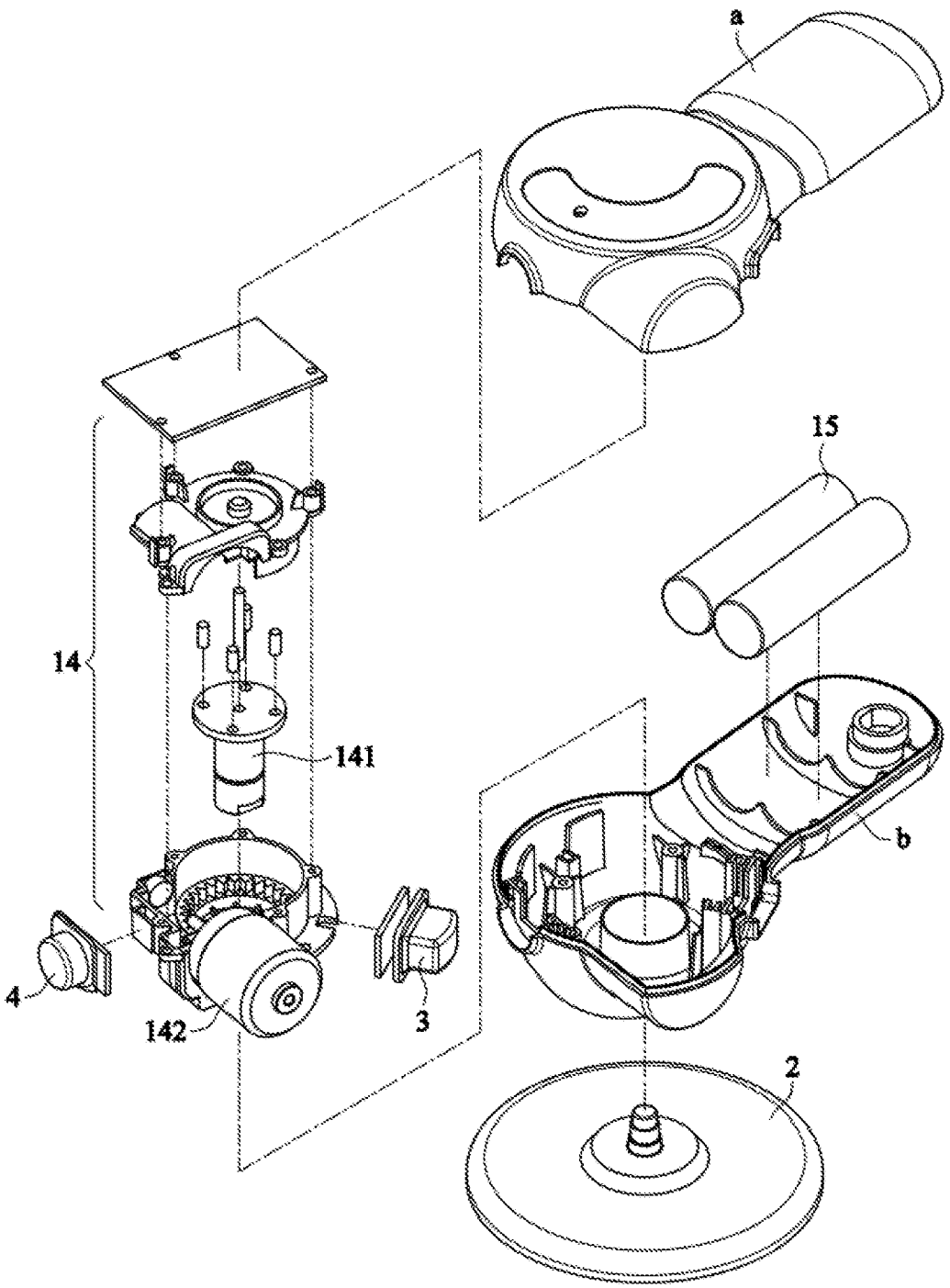

Please refer to FIG. 1-1 and FIG. 1-2. They are the first and second perspective schematic views of the machine tool main body of the handheld machine tool according to the present invention respectively. The handheld machine tool according to the present invention mainly comprises a machine tool main body 1 and a tool part (as described later) connected thereto. As shown, the machine tool main body 1 comprises a round housing 11, a grip portion 12 and a convex portion 13. By appearance, the round housing 11 is a cylindrical shape which is wide at the top and narrow at the bottom. The round housing 11 has a shaft accommodation portion 111 disposed at the bottom, and the shaft accommodation portion 111 has an opening 112. The grip portion 12 and the convex portion 13 are both disposed on a side of the round housing. It should be noted, although the machine tool main body 1 is distinguished into the round housing 11, the grip portion 12, and the convex portion 13 that are connected to each other, the outer casing of the machine tool main body 1 is composed of two hollow shells combined up and down in the term of manufacturing the outer casing. In other words, the two hollow shells form an accommodating space inside the two hollow shells when they are combined.

Please refer to FIG. 2. FIG. 2 is a schematic exploded view of the handheld machine tool according to the present invention. It can be more clearly seen from FIG. 2 that a first shell a and a second shell b are combined into the outer casing of the machine tool main body 1, and an accommodating space is in the outer casing. The machine tool main body 1 can comprise a transmission module 14. The transmission module 14 is disposed inside the round housing 11, and is used to provide power for the tool part 2 which is connected to the machine tool main body 1. The transmission module 14 mainly comprises a transmission shaft 141 and a motor 142. The transmission shaft 141 is disposed at the opening 112 of the shaft accommodation portion 111 to connect the tool part 2, and the motor 142 is disposed inside the convex portion 13. The transmission module 14 may include a worm, an epicyclic gear set, and a control board in addition to the transmission shaft 141 and the motor 142. The design of these mechanical components allows the machine tool main body 1 to reduce the number of internal components, in order to achieve the effect of reducing the volume of the machine tool main body 1 without affecting the magnitude of the output power.

The machine tool main body 1 can further comprise a power module 15. The power module 15 is disposed inside the grip portion 12, and is used to provide the power for the transmission module 14. The power module 15 can be a rechargeable battery or a power cable for connecting to an external power source, but is not limited thereto.

In an embodiment, the handheld machine tool can further comprise a first button 3 and a second button 4. The first button 3 is disposed on the curved side of the round housing 11 and located between the grip portion 12 and the convex portion 13. When the user presses the first button 3, the transmission module 14 is activated. When the first button 3 is released, the transmission module 14 stops operating. When the transmission module 14 is activated, the tool part 2 connected to the transmission shaft 141 is driven to start rotating. The second button 4 is disposed on the curved side of the round housing 11 and located near the convex portion 13. The second button 4 is used to set the speed of the motor 142 of the transmission module 14. As shown, the first button 3 and the second button 4 are respectively disposed on both sides of the convex portion 13. In addition, an indicator light 16 can also be arranged on the top of the round housing portion 11 of the machine tool body 1 according to the present invention for displaying the rotational speeds of different stages.

Figure 3:
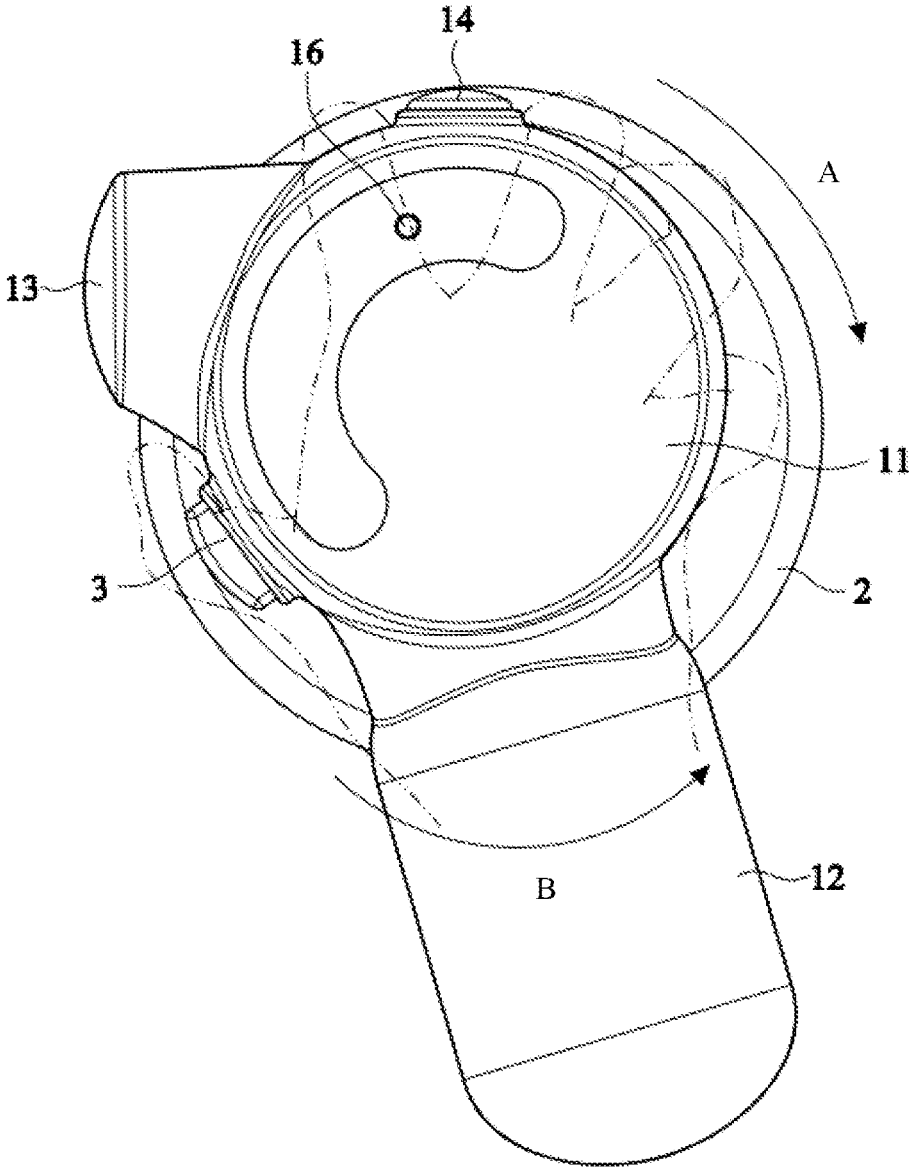
FIG. 3 is a schematic view illustrating a user holding the machine tool main body.

The positional arrangement of the internal components of the machine tool main body 1 according to the present invention, such as the transmission module 14 being disposed in the round housing 11 and the power module 15 being disposed in the grip portion 12, can help adjust the center of gravity of the entire handheld machine tool. In addition to be easy to grasp by the user, it can also produce the effect of offsetting the rotating torque of the machine tool. Please refer to FIG. 3. FIG. 3 is a schematic view illustrating that the user holds the machine tool main body. The user can apply several ways to grasp when operating the handheld machine tool according to the present invention. One is to directly grasp on the position of the grip portion 12. Another is to grasp on the round housing 11 with the hand (dashed line), as shown in FIG. 3. At this time, the palm of the hand will cover the center of the round housing 11, and the fingers are respectively gripped around the sides of the round housing 11.

Furthermore, as shown in FIG. 3, it takes the right hand as the dominant hand for an example, but not limited to this. When the user grasps the round housing 11, he/she may also press on the first button 3 with his/her thumb at the same time to make the tool part 2 rotated in a first direction A, which would create a rotational moment of inertia. The machine tool main body 1 is affected by the rotational inertia and tends to be rotated in a second direction B opposite to the first direction A of the tool part 2 (as the directions of the two arrows in FIG. 3, respectively). Therefore, the user needs to grasp the machine tool main body 1 with exertion to avoid the machine tool main body 1 is rotated by inertia effects. At the same time, the user must keep pressing the first button 3 (activated button) to keep the machine tool operating when activating the handheld machine tool. According to the design of the present invention, the position of the first button 3 is just in the direction of inertia of the rotation of the machine tool main body 1. When the user keeps pressing the first button 3 with the finger, the machine tool main body 1 drives the tool part 2 to keep operating. Further, when the machine tool main body 1 is rotated in the second direction by the inertia, the second direction may be towards and against the user's thumb on the first button. Therefore, the user can keep pressing the first button 3 easily by means of the rotating tendency of the machine tool main body 1 without pressing with exertion. This can achieve a labor-saving effect and avoid the user's hand stiffness or fatigue caused by keeping pressing of the button.

In summary, the present invention provides a handheld machine tool comprising a machine tool main body and a tool part. The appearance of the machine tool main body is designed to facilitate hand grip. Moreover, the torque of the handheld machine tool is effectively cancelled and the labor-saving effect is achieved through the internal component configuration of the machine tool and the design of the button position.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A handheld machine tool comprising:

a machine tool main body comprising:

a round housing which is cylindrical and having a shaft accommodation portion disposed at a bottom of the round housing, and the shaft accommodation portion has an opening;

a grip portion disposed on a side of the round housing; and a convex portion projecting from a side of the round housing;

a tool part connecting to the machine tool main body through the shaft accommodation portion; and a first button disposed on a side of the round housing and located between the grip portion and the convex portion; when a user presses the first button with his/her thumb to turn on the handheld machine tool, the tool part is rotated in a first direction, and meanwhile the machine tool main body is rotated in a second direction opposite to the first direction of the tool part, wherein the second direction is towards and against the user's thumb on the first button.

2. The handheld machine tool of claim 1, wherein the machine tool main body further comprises:

an outer casing comprising a first shell and a second shell, wherein the opening is disposed on the second shell; and an accommodating space in the outer casing.

3. The handheld machine tool of claim 2, wherein the machine tool main body further comprises a transmission module disposed inside the round housing, and the first button is used to activate the transmission module.

4. The handheld machine tool of claim 3, wherein the transmission module comprises a transmission shaft and a motor, the transmission shaft is disposed at the opening of the shaft accommodation portion to connect the tool part, and the motor is disposed inside the convex portion.

5. The handheld machine tool of claim 4, further comprising a second button disposed at a side of the round housing and adjacent to the convex portion, wherein the second button is used to set the motor speed of the transmission module.

6. The handheld machine tool of claim 3, wherein the machine tool main body further comprises a power module disposed inside the grip portion, wherein the power module is used to provide the power for the transmission module.

* * * * *